US005303864A

United States Patent [19]

Hirota

[11] Patent Number: 5,303,864

[45] Date of Patent: Apr. 19, 1994

[54] EXPANSION VALVE

[75] Inventor: Hisatoshi Hirota, Hachioji, Japan

[73] Assignee: Deutsche Controls GmbH, Munich, Fed. Rep. of Germany

[21] Appl. No.: 882,850

[22] Filed: Dec. 14, 1992

[30] Foreign Application Priority Data

| | | | |
|---|---|---|---|
| May 14, 1991 | [JP] | Japan | 3-108043 |
| Dec. 2, 1991 | [JP] | Japan | 3-317726 |
| Dec. 3, 1991 | [JP] | Japan | 3-318751 |
| Apr. 22, 1992 | [EP] | European Pat. Off. | 92106896.1 |

[51] Int. Cl.[5] ..... F25B 41/04

[52] U.S. Cl. ..... 236/92 B; 62/225

[58] Field of Search ..... 62/225; 236/92 B, 49 R; 374/201

[56] References Cited

U.S. PATENT DOCUMENTS

| | | | |
|---|---|---|---|
| 3,667,247 | 6/1972 | Proctor | 62/225 X |
| 4,819,443 | 4/1989 | Watanabe et al. | 62/225 |
| 4,979,372 | 12/1990 | Tanaka | 62/225 |
| 5,044,170 | 9/1991 | Tanaka | 374/201 X |
| 5,060,485 | 10/1991 | Watanabe et al. | 62/225 |
| 5,127,237 | 7/1992 | Sendo et al. | 62/225 |

*Primary Examiner*—William E. Tapocai
*Attorney, Agent, or Firm*—Nilles & Nilles

[57] ABSTRACT

In an expansion valve for controlling the flow rate of a refrigerant supplied to an evaporator of a refrigerating system, a temperature-sensing chamber is provided to sense the temperature of the refrigerant returning from said evaporator and to actuate a valve mechanism in order to regulate the flow of refrigerant supplied to said evaporator. An adsorption means provided inside the temperature-sensing chamber to adsorb a liquefied part of a gas charge within said chamber in order to hold said liquefied part away from warm wall parts inside said chamber. In addition, or as an alternative, said temperature-sensing chamber is separated from a return passage of said refrigerant by thermal-transfer-delay means for delaying the thermal transfer of a temperature change from the refrigerant to a sealed charge within said temperature-sensing chamber. Said thermal-transfer-delay means can be made as a flow restrictor for supressing an excessive flow between said chamber and said return passage of the refrigerant.

30 Claims, 5 Drawing Sheets

EXPANSION VALVE

The present invention relates to an expansion valve for controlling the flow rate of a refrigerant supplied to an evaporator of a refrigerating system.

Such valves typically comprise a housing and a temperature-sensing chamber located to sense the temperature of the refrigerant returning from an evaporator. The temperature-sensing chamber contains a sealed charge of at least a saturated vapor gas, and a displaceable diaphragm wall having a surface inside the temperature-sensing chamber.

BACKGROUND OF THE INVENTION

Expansion valves as known from U.S. Pat. No. Re. 23,706; U.S. Pat. Nos. 4,819,443 and 4,979,372 control the flow rate of a refrigerant supplied to an evaporator by means of a valve mechanism which is driven by the displaceable diaphragm wall forming one wall of a temperature-sensing chamber. The valve mechanism opens or closes a supply passage for the refrigerant. The temperature-sensing chamber contains at least a saturated vapor gas responding by pressure changes to temperature changes in the refrigerant returning from the evaporator. The temperature-sensing chamber is either provided in the return passage or at an exterior side of the expansion valve housing. Within the temperature-sensing chamber, the diaphragm surface has a lower temperature than the other confining walls so that the saturated vapor gas at least partially condenses and liquefies on the diaphragm wall surface. Depending on the position of the expansion valve, the liquefied part of the saturated vapor gas can contact other and warmer wall portions of the temperature-sensing chamber, and starts to evaporate and gasify again, resulting in a rapid rise of the pressure in the temperature-sensing chamber. Since the pressure of the saturated vapor gas attributable to the diaphragm surface temperature is lower than the pressure of the saturated vapor gas, the gas again condenses on said diaphragm wall surface. As a result, the pressure in the temperature-sensing chamber periodically fluctuates which leads to an actuation of the valve mechanism. Accordingly, the refrigerant flow rate towards the evaporator fluctuates uninterruptedly. This leads to an unstable refrigeration cycle in the refrigerating system. Furthermore, if the position of the expansion valve is changed in an uncontrolled manner, for example, in a moving vehicle the refrigeration cycle may be varied constantly even if cooling demand remains unchanged.

Moreover, the valve opening curve of an expansion valve depends entirely upon the properties of the sealed charge in the temperature-sensing chamber. It is difficult to set a desired ideal valve-opening curve in cases where the sealed charge is only a saturated valve gas identical or similar in nature to the refrigerant being controlled.

Furthermore, when minute changes of the temperature of the refrigerant returning from the evaporator are transferred to the sealed charge in the temperature-sensing chamber too rapidly, minute pulsations result in the refrigerant flow. Such minute changes in the superheat of the refrigerant directly cause the valve mechanism to open and to close and lead to an unstable expansion valve operation. Such temporary changes in the refrigerant temperature at the return side of the evaporator unavoidably occur even during normal operation of the refrigerating system. However, these minute and transient temperature changes should not be considerably affect the operation of the expansion valve.

SUMMARY OF THE INVENTION

It is an object of the present invention to avoid an unstable operation of the valve mechanism and to achieve a stable expansion valve operation. With an expansion valve according to the invention, influences of an inclined valve position and/or a variation of the expansion valve position and/or periodically occuring temperature changes in the returning refrigerant flow on the expansion valve operation ought to be eliminated or at least minimized to a considerable extent.

A further object of the invention is to provide an expansion valve, the valve opening curve of which can be set in a desired ideal manner even with a sealed charge of a saturated vapor gas within the temperature-sensing chamber identical to or similar in nature to the refrigerant circulating in the refrigerating system.

These and other objects may be achieved by providing an absorption means inside the temperature-sensing chamber to absorb a liquefied part of the saturated vapor gas which is condensed and liquefied on the surface of the diaphragm wall and to hold the liquefied part on the surface of the diaphragm wall inside the temperature-sensing chamber. Instead of and/or in addition to the absorption means, the temperature-sensing chamber may be separated from the return passage by a thermal-transfer-delay means, provided between the return passage and the temperature-sensing chamber, for delaying the internal transfer of a temperature change from the refrigerant in the return passage to the sealed charge within the temperature-sensing chamber.

Having an adsorption means inside said temperature-sensing chamber to adsorb a liquefied part of said saturated vapor gas and to hold said liquefied part on said diaphragm wall surface prevents said liquefied part from contacting hotter wall surfaces when the position of the expansion valve or a variation of the position of the expansion valve normally would force the liquefied part towards said hotter walls. Irrespective of whatever position the expansion valve may be installed at, or how it changes its position during operation, a stable refrigeration cycle free from fluctuations of the refrigerant flow is achieved. An optimum valve-opening curve desired to supply the refrigerant to the evaporator can freely be set.

With a thermal-transfer-delay means separating the temperature-sensing chamber from the return passage of the refrigerant, minute changes or fluctuations of the temperature of the returning refrigerant do not generate uncontrolled opening or closing movements of the valve mechanisms which could otherwise result in unstable valve operation, because the transfer of such temperature changes is delayed significantly until a change in the refrigerant temperature can reach the sealed change within the temperature-sensing chamber. A stable refrigeration cycle free from a fluctuation of the refrigerant flow is achieved irrespectively of minute temperature changes in the returning refrigerant flow.

An optimal operation of the expansion valve and stable refrigeration cycles are achieved with an expansion valve having an adsorption means inside said temperature-sensing chamber to adsorb a liquefied part of the saturated vapor gas and to hold the liquefied part on the diaphragm wall surface and, additionally, a thermal-transfer-delay means, optionally in the form of a flow-restrictor, separating said temperature-sensing chamber from said return passage for delaying the thermal transfer of a temperature change in the refrigerant in the return passage to the sealed charge within the temperature-sensing chamber. Both combined measures lead to an expansion valve the operating behavior of which is not affected by position changes or critical positions of the expansion valve and by minute temperature changes in the returning refrigerant flow. The valve operating curve of the expansion valve can be set ideally.

With a further preferred embodiment of the expansion valve having a sealed charge of a mixture of at least one saturated vapor gas identical to or similar in nature to the refrigerant circulating in the refrigerating system and an inert gas or a mixture of several saturated vapor gases and an inert gas allows it to set the operation characteristics of the expansion valve to an ideal valve-opening curve desired to supply the refrigerant into the evaporator. By using particular mixtures as the sealed charge, the temperature-pressure curve under which the expansion valve opens will be moved in parallel because the pressure obtainable from the partial pressure of the inert gas is added to the pressure of the saturated vapor gas. The valve-opening curve of the expansion valve or the temperature-pressure curve shows a gradient which remains unchanged in comparison with the gradient of the saturated vapor gas. However, the pressure level within a predetermined range of working temperatures is generally raised to a profound level by the influence of the inert gas. To match the above-mentioned curve gradient with a desired one, it furthermore is possible according to a further embodiment of the invention to use a plural number of saturated vapor gases with different curve gradients in a mixture. Again the pressure level can be moved in parallel to a desired level with an inert gas mixed into said mixture of a plurality of saturated vapor gases. Said object of the invention can be of particular importance for so-called load-controlled compressors which increasingly are applied in refrigerating systems, particularly air conditioning systems of automobiles. A load-controlled compressor is driven by the engine of the automobile, the speed of which depends on the load condition. The load controlled compressor works with a relatively high or increased output under low speed but with relatively low or decreased output with high speed. Particularly under low speed and high output conditions, such compressor may need lubrication by the refrigerant circulating in the refrigerating system in order to avoid dry-running. Setting the pressure level and the curve gradient of the valve-opening curve of the expansion valve with the help of the above-mentioned mixture of a saturated vapor gas and an inert gas, or a plurality of saturated vapor gases and an inert gas, does not only lead to a defrosting effect for the evaporator under critical working conditions, but also establishes a lubrication of the compressor during its low speed and high output operation. The combination of the above-mentioned measures according to the objects of the invention result in an ideally adjusted expansion valve for an ideal and stable refrigerating cycle and an ideal adaptation to the operating behaviour of the compressor.

Further preferred embodiments are disclosed in the accompanying depending claims.

BRIEF DESCRIPTION OF THE DRAWINGS

Embodiments of the invention will be explained on the basis of the following drawings.

DESCRIPTION OF THE PREFERRED EMBODIMENTS

Figure 1:
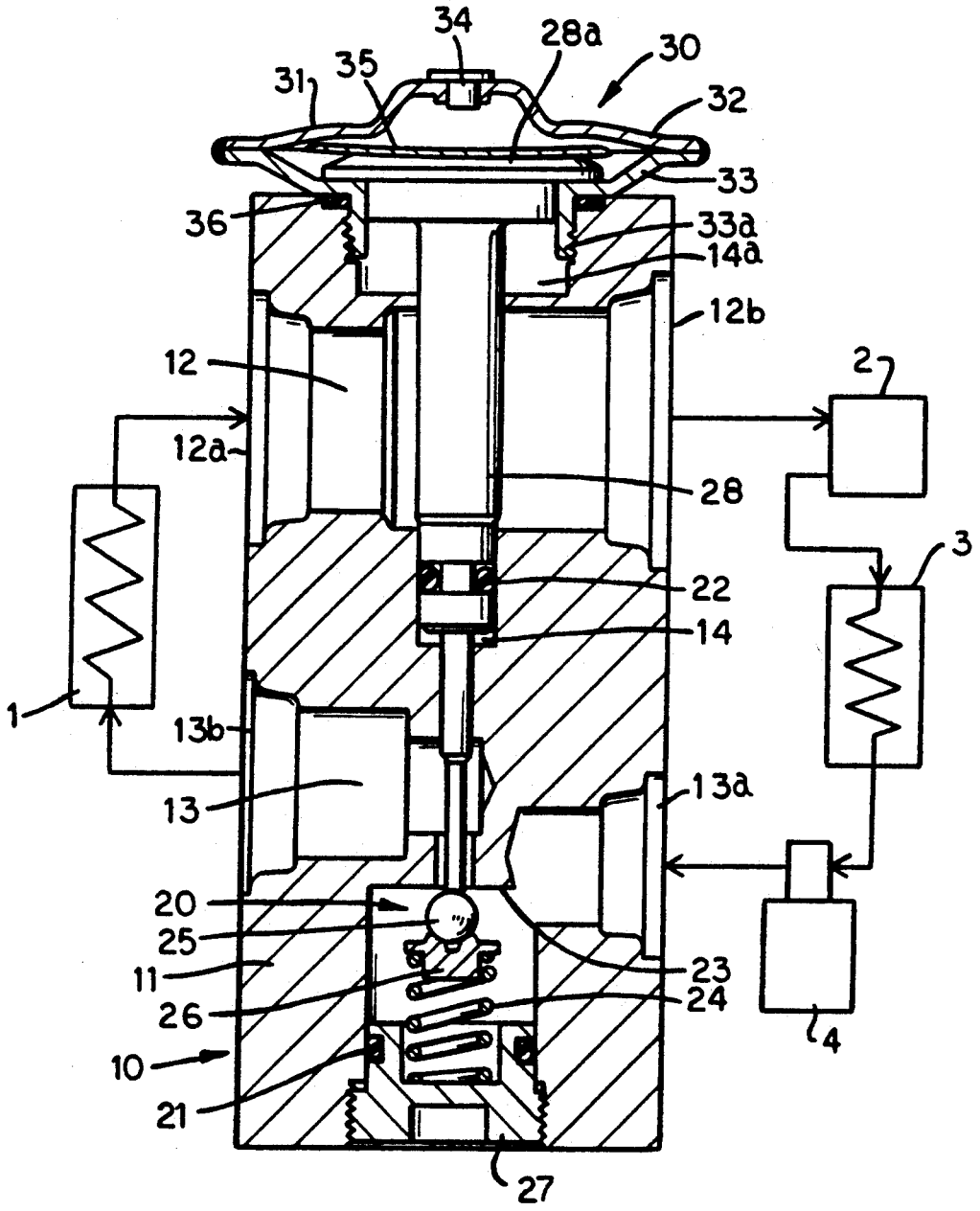
FIG. 1 schematically shows a refrigerating system with a first embodiment of an expansion valve in a longitudinal section FIG. 1A schematically shows a refrigerating system with a second embodiment of an expansion valve in longitudinal section.

In a refrigerating system as shown in FIG. 1, a compressor 2 is connected to a condenser 3 which supplies refrigerant to a liquid recipient or drying container 4 which in turn is connected via a high-pressure supply passage 13 in a housing 11 of an expansion valve 10 with the inlet of an evaporator 1. The outlet of evaporator 1 is connected via a low-pressure return passage 12 in the housing 11 with the inlet side of compressor 2. Inlet side **12*a* of return passage 12 is connected to the exit of evaporator 1. Outlet side 12*b* of return passage 12 is connected with the inlet of compressor 2. Inlet side 13*a* of supply passage 13 is connected to recipient 4, while the outlet side 13*b* is connected to the inlet of evaporator 1. Passages 12 and 13 are formed in parallel to each other within housing 11. A bore 14 being perpendicular to both passages extends through housing 11 and intersects both passages. Housing bore 14*a* communicate with the exterior and serves to mount a temperature-sensing chamber 30 in the exit of housing bore 14*a***.

In the interior of housing 11 a valve mechanism 20 is provided. A valve seat 23 is formed in supply passage 13 at the intersection between supply passage 13 and bore 14. A valve closure member 25, preferably a steel ball, faces a valve seat 23. Closure member 25 is biased by coil spring 24, and additionally by the outlet pressure of recipient 4. Closure member 25 is held on a supporting member 26. Coil spring 24 is provided between supporting member 26 and an adjusting screw 27 which closes the lower end of housing bore 14. O-rings 21 and 22 are provided for sealing purposes.

Within housing bore **14*a* push-rod 28 is axially slideably installed. Push rod 28 extends between temperature-sensing chamber 30 and valve seat 23. As soon as closure member 25 is pushed downwardly by push-rod 28 against the force of coil spring 24 and against the outlet pressure of recipient 4, high pressure refrigerant is supplied to the inlet of evaporator 1. As soon as closure member 25 overcomes the pushing force of push-rod 28 or as soon as push-rod 28 is moved upwardly, closure member 25 seats on valve seat 23 and interrupts the supply of refrigerant to the inlet of evaporator 1**.

Temperature-sensing chamber 30 is provided on the exterior side of housing 11 close to return passage 12. It is formed by an outer chamber wall 31 made of a thick metal plate. Inside chamber 30 a displaceable diaphragm wall 32 made of a flexible thin metal plate, for example, 0.1 mm thick stainless steel plate, is provided. Wall 31 is connected to a seat body 33 which is mounted in the upper end of large housing bore **14*a*. Wall 31 and seat body 33 are hermetically welded along their common entire circumferences and hermetically include diaphragm wall 32. Seat body 33 is threaded with a threaded cylindrical neck portion 33***a* into housing bore 14*a*. O-ring 36 serves to seal seat body 33. Inside chamber 30 defined by chamber wall 31 and the upper surface of diaphragm wall 32 a charge of saturated vapor gas is sealed which is identical or similar in nature to the refrigerant circulating in the refrigerating system. On the surface of diaphragm wall 32 inside temperature-sensing chamber 30 adsorption means 35 are provided. Adsorption means 35 serves to adsorb a liquid part of the saturated vapor gas condensed and liquefied within chamber 30.

The adsorption means 35 is, for example, a porous, synthetic hydrophile resin applied to the surface of diaphragm wall 32. Furthermore, it can be liquid glass applied to and baked on the surface of diaphragm wall 32. Moreover, a felt or a variety of fibers or the like attached to the surface of diaphragm wall 32 may serve as the adsorption means 35. Even an inorganic substance having a porous surface may be provided or added for achieving the adsorption effect. Adsorption means 35 may be provided on the entire surface of diaphragm wall 32 or solely on a portion thereof.

Push-rod 28 has an enlarged top-part 28, the large area of which interferes and comes into contact with the lower surface of diaphragm wall 32. Top part 28*a* slideably engages in neck portion 33*a* of seat body 33 and can prevent a direct and unrestricted flow of refrigerant from return passage 12 towards the lower side of diaphragm wall 32. The refrigerant mainly transfers its temperature to diaphragm wall 32 via top part 28*a* and seat body 33. Top part 28*a* with its lower neck portion optionally may cooperate with the cylindrical neck portion 33*a* of seat body 33 as a flow restricting means and a thermal-transfer-delay barrier between return passage 12 and the lower side diaphragm wall 32. Top part 28*a* as well as the upper part of push-rod 28 may be made from a material with low thermal conductivity.

As a result, the refrigerant flowing in return passage 12 transfers its temperature and temperature changes to diaphragm wall 32 via push-rod 28 and its top part 28 and via seat body 33.

If the temperature in return passage 12 drops, the temperature of diaphragm wall 32 will drop accordingly. The saturated vapor gas in chamber 30 will start to condense on the upper internal surface of diaphragm wall 32. The pressure in chamber 30 decreases so that push-rod 28 is shifted upwardly by coil spring 24 and the outlet pressure of recipient 4. Firstly, closure member 25 approaches valve seat 23 and reduces the flow rate of refrigerant in supply passage 13 so that the refrigerant will flow into evaporator 1 at a reduced flow rate. It even might happen that closure member 25 contacts valve seat 23 and interrupts the flow.

Adsorption means 35 adsorbs the liquid part of the saturated vapor gas inside chamber 30. Irrespectively of the position of the expansion valve or any position variation, the liquid part condensed is held by the adsorption means 35 on the internal surface of diaphragm wall 32 so that it cannot come into contact with chamber wall 31.

In response to a temperature rise in return passage 12 the temperature of diaphragm wall 32 will rise accordingly but preferably with a considerable delay. The liquefied parts held by adsorption means 35 will start to gasify again. The internal pressure in chamber 30 increases. Consequently, diaphragm wall 32 will be displaced until push-rod 28 will separate closure member 25 from valve seat 23. The flow rate of refrigerant into evaporator 1 increases.

Figure 2:
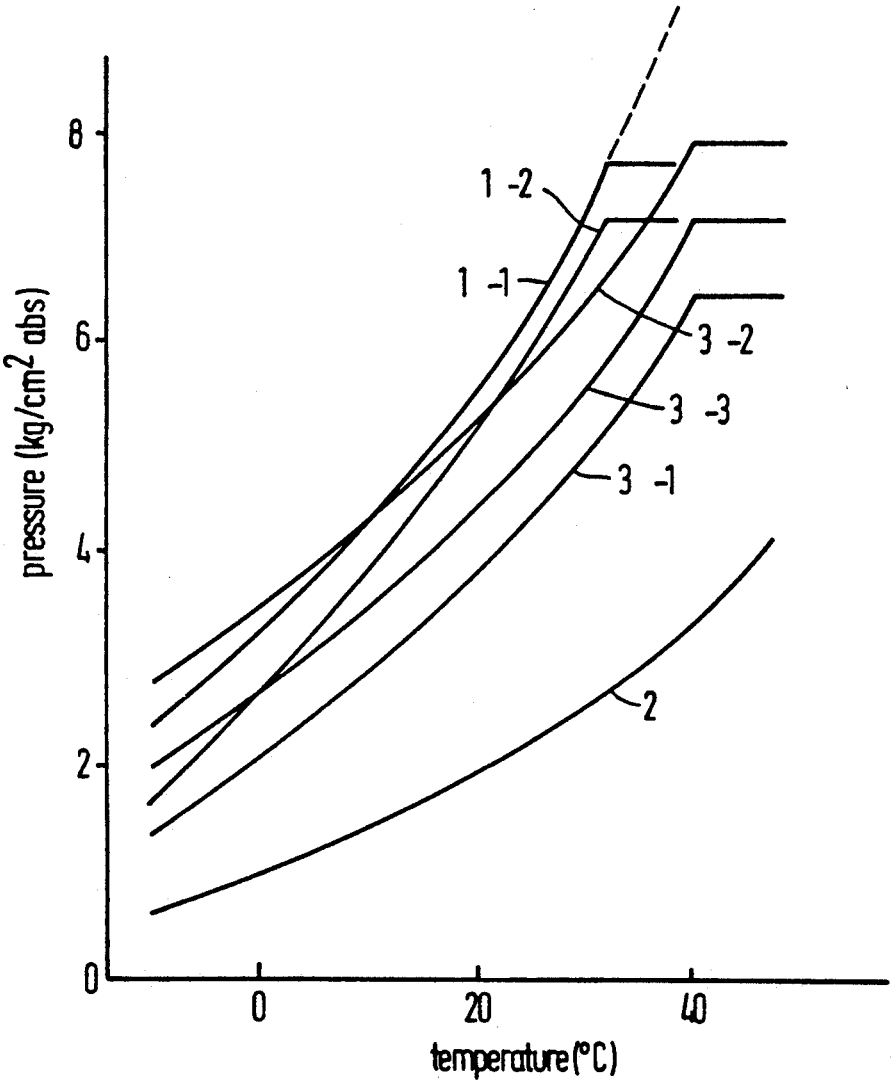
FIG. 2 schematically shows a diagram illustrating several temperature-pressure curves.

The sealed charge in chamber 30 contains a mixture of saturated vapor gases of refrigerants of the types R-12 and R-114 in a ratio of preferably 2:3. Additionally, this mixture contains an inert gas as nitrogen gas. Mixing R-12 and R-114 at a ratio of 2:3 optimizes the gradient of the temperature-pressure curve (3)-1 in FIG. 2. Having an inert nitrogen gas in said mixture moves the curve in parallel towards a higher pressure level as shown by curve (3)-2. Taking the force of coil spring 24 and the outlet pressure of recipient 4 into consideration, the valve-opening curve (3)-3 results for the expansion valve are optimized as desired as it is moved in parallel towards a slightly lower pressure level than curve (3)-2. The curve (1)-1 represents a saturated vapor pressure curve for the refrigerant used in the refrigeration cycle, for example, R12, R134a, etc. The curve of (1)-2 represents the operating characteristics of the valve (opening and closing characteristics), which reflects the combined characteristics of curve (1)-1 and the force of the coil spring (24) for adjusting the superheat. The curve (1)-2 is lowered in parallel compared to curve (1)-1. Curve (2) represents the thermal sensing gas, which is to be used when a characteristic lower than those of R12, R114, RC318, or a mixture thereof is required, for example, the saturated vapor pressure curve for R11.

A curve gradient can be set as desired by selecting a mixture ratio of even two or more saturated vapor gases. A pressure level within a predetermined range of working temperatures can be freely set by selecting the mixing ratio of the inert gas. Thus, the most ideal valve-opening curve can be established.

Figure 3:
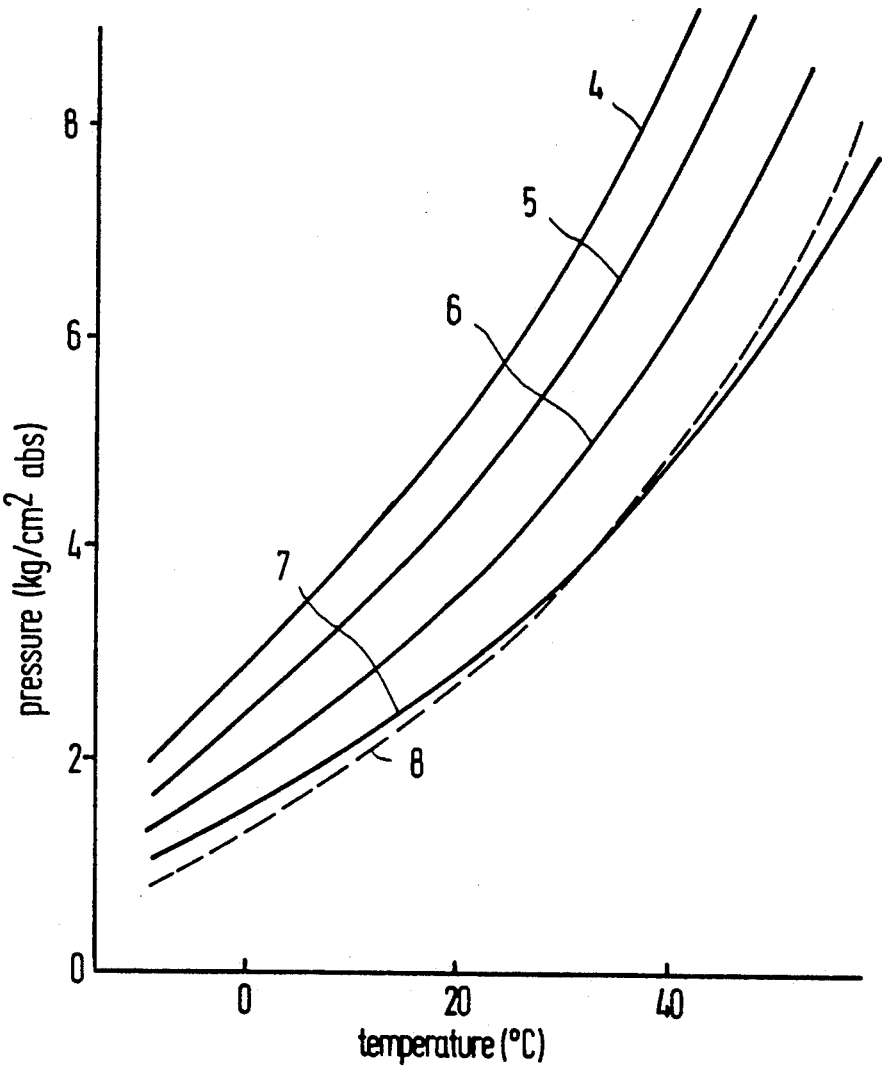
FIG. 3 shows a diagram illustrating several temperature-pressure curves.

FIG. 3 illustrates further temperature-pressure-curves which can be established by changing the mixture ratio or by using refrigerant of the type RC-318. The curves (4), (5), (6) and (7) can be achieved when changing the mixing ratio between R-12 and R-114 between 4:1, 3:2, 2:3 and 1:4. In addition, curve (8) belongs to RC-318 which is refrigerant applicable as the saturated vapor gas for the sealed charge in chamber 30.

The curve gradient of RC-318 is situated intermediate between the curve gradients of R-12 and R-114. If that gradient of RC-318 is sufficient for the desired working behaviour only RC-318 may be used as the saturated vapor gas and then is mixed with an inert gas to correct the pressure level only.

Figure 1A:
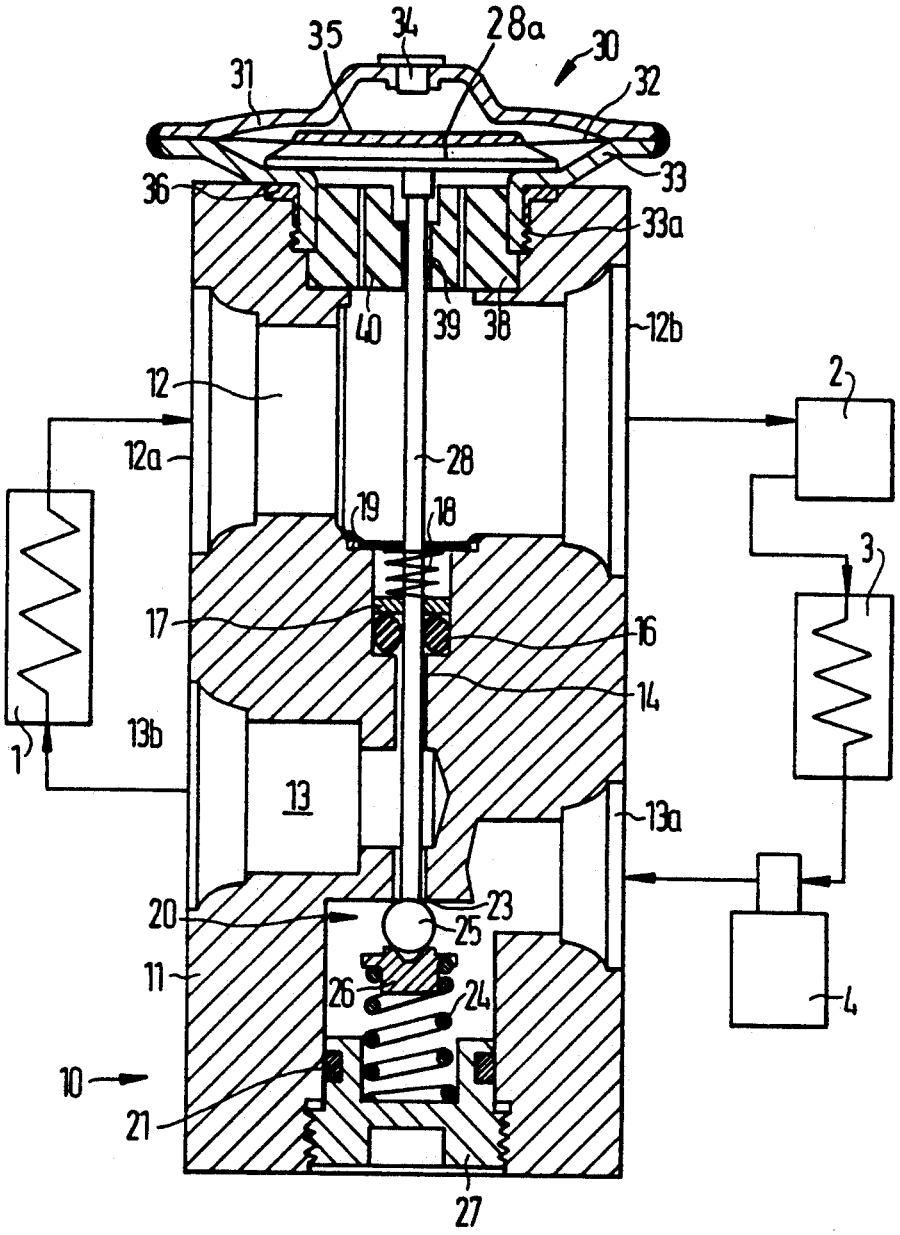

In the embodiments of FIG. 1A of expansion valve 10, identical components have been marked with the same reference numbers as in FIG. 1. For simplicity's sake, only the differences between the embodiments of FIG. 1A and FIG. 1 will be described. Push-rod 28 is made of a material having a substantially low thermal conductivity, e.g., lower than aluminum. Preferably push-rod 28 is made of stainless steel. Its diameter is minimized to obtain the smallest possible cross-sectional area while, nevertheless, securing the required mechanical strength for transmitting the forces between diaphragm wall 32 and closure member 25. The temperature and temperature changes of the refrigerant in return passage 12 are transferred to diaphragm wall 32 via push-rod 28 only in a limited or restricted manner. Instead of a solid push-rod 28, a tube can be used in order to further reduce the cross-sectional area for the thermal transfer. O-ring 16 is provided in a widened section of housing bore 14 adjacent the lower side of return passage 12. O-ring 16 serves to seal passages 12 and 13 from each other and additionally serves to dampen or retard the longitudinal movement of push-rod 28. For that purpose a small coil spring 18 presses via ring 17 on O-ring 16. Coil spring 18 is supported by ring 19 made of spring material and being glued or welded to the housing 11. O-ring 16 thus exerts a radial load on push-rod 28 in order to dampen its longitudinal movements by friction.

Blind plug 34 closes as in FIG. 1 an opening in chamber wall 31 which opening is used for filling the charge into chamber 30.

Top part 28*a* of push-rod 28 is a relatively thin, dish-shaped plate, the external diameter of which is bigger than the internal diameter of neck portion 33*a* of seat body 33.

An intermediary plug 38 is provided as a means for delaying thermal transfer from return passage 12 to the lower side of diaphragm wall 32. Intermediary plug 38 can be made of a material having low thermal conductivity, for example, rubber or plastic material. Intermediary plug 38 additionally restricts the flow of refrigerant from return passage 12 towards the lower side of diaphragm wall 32, thus delaying the transfer of pressure changes in return passage 12 to the lower side of diaphragm wall 32. It can further be made from porous material which is gas-permeable.

Push-rod 28 slideably penetrates the center of intermediary plug 38 in a bore 39 which defines a narrow central and annular flow gap. Additionally a plurality of bores 40 can be provided in intermediary plug 38. Intermediary plug 38 can be held in position by seat body 33. It furthermore is possible to glue it either to seat body 33 or into large housing bore 14*a*.

Normally, a change in the temperature of the refrigerant in return passage 12 would be transferred to diaphragm wall 32 within a second or two if said intermediary plug 38 or another thermal-transfer-delaying and/or flow-restricting means was not provided. However, said intermediary plug 38 delays the thermal transfer for as long as several tens of seconds. The number or size of bores 39 and 40 can be selected in order to match with the desired operation behavior of the expansion valve. In addition, intermediary plug 38 can be made of a material allowing air or gas to penetrate through it, e.g., from a porous material. The result of the application of said intermediary plug is that the diaphragm wall 32 will move at a very slow response speed when minute temperature changes occur in the return passage refrigerant which prevent the valve mechanism from responding to such minute temperature changes.

Figure 4:
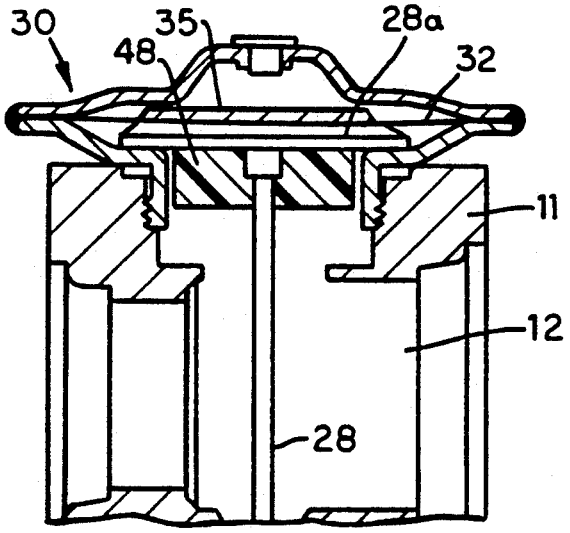
FIG. 4 schematically shows in a longitudinal section a third embodiment of an expansion valve.

In the embodiment according to FIG. 4 a thermal insulating plug 48 in the form of a thick annulus is fixed either to push-rod 28 or to top part 28*a*. If any, a gap between the plug 48 and push-rod 38 has a narrow radial dimension. Between the outer circumference of plug 48 and the cylindrical neck portion of seat body 33 discrete flow passages or a circumferentially extending narrow gap is defined. Intermediary plug 38 of FIG. 1A as well as plug 48 of FIG. 4 can be made from a material which is porous or spongy allowing at least gasified refrigerant to penetrate through. Moreover, plug 38, 48 can be structurally integrated into top part 28*a* forming a unitary structural member, preferably made from a material having a low thermal conductivity. In addition, diaphragm wall 32 can be made of a material having a low thermal conductivity.

I claim:

1. An expansion valve for controlling the flow rate of a refrigerant supplied to an evaporator of a refrigerating system, comprising:

a housing;

a temperature-sensing chamber being located to sense the temperature of the refrigerant returning from said evaporator, said temperature-sensing chamber containing 1) a sealed charge of at least a saturated vapor gas, and 2) a displaceable diaphragm wall having an inside surface located inside said temperature-sensing chamber, said sealed charge being operable to convert sensed temperature changes into a pressure change within said temperature-sensing chamber, said diaphragm wall responding by displacement to said pressure changes within said temperature-sensing chamber;

a valve mechanism located in a refrigerant supply passage of said housing, said valve mechanism being actuated by displacement of said diaphragm wall of said temperature-sensing chamber to open and to close said supply passage; and an adsorption means, fixed to said inside surface of said diaphragm wall, for absorbing a liquefied part of said saturated vapor gas which is condensed and liquefied on said surface of said diaphragm wall and for holding said liquefied part on said inside surface of said diaphragm wall.

2. Expansion valve as in claim 1, wherein said diaphragm wall is a flexible, thin plate.

3. Expansion valve as in claim 2 wherein said thin plate is made from stainless steel with a thickness of about 0.1 mm.

4. Expansion valve as in claim 2, wherein said adsorption means at least partially covers said inside surface of said diaphragm wall.

5. Expansion valve as in claim 1, wherein said adsorption means is made of a porous, synthetic, hydrophile resin applied to said inside surface of said diaphragm wall.

6. Expansion valve as in claim 1, wherein said adsorption means is liquid glass, baked on said inside surface of said diaphragm wall.

7. Expansion valve as in claim 1, wherein said adsorption means is a felt or a variety of fibers.

8. Expansion valve as in claim 1, wherein an inorganic substance having a porous surface is added in said chamber for achieving an adsorption effect.

9. Expansion valve as in claim 1, wherein said sealed charge is a mixture of 1) at least one saturated vapor gas identical to or similar in nature to said refrigerant, 2) and an inert gas.

10. Expansion valve as in claim 9, wherein said at least one saturated vapor gas is a refrigerant of the type R12, R114 or RC318.

11. Expansion valve as in claim 9, wherein said sealed charge is a mixture of a plurality of saturated vapor gases like refrigerants of the type R12, R114, RC318 and an inert or inactive gas.

12. Expansion valve as in claim 11, wherein, as said saturated vapor gases, refrigerants R12 and R114 are mixed at a ratio between 4:1 and 1:4.

13. Expansion valve as in claim 9, wherein said inert or inactive gas is nitrogen gas.

14. Expansion valve as in claim 9, wherein said inert inactive gas is at least one of argon and helium.

15. Expansion valve as in claim 9, wherein said inert inactive gas includes at least one of nitrogen gas, and argon, and helium.

16. Expansion valve as in claim 12, wherein said ratio is about 2:3.

17. An expansion valve for controlling the flow rate of a refrigerant supplied to an evaporator of a refrigerating system, comprising:

an expansion valve housing with a high-pressure supply passage and a low-pressure return passage;

a temperature-sensing chamber located to sense the temperature and pressure of the refrigerant returning from said evaporator, said temperature-sensing chamber containing 1) a sealed charge of at least a saturated vapor gas, and 2) a displaceable diaphragm wall having a surface within said temperature-sensing chamber;

a valve mechanism including a valve in said supply passage, said valve mechanism being actuated by displacement of said diaphragm wall via at least one push-rod to open and to close said supply passage; and thermal-transfer-delay means, separating said temperature-sensing chamber from said return passage and provided between said return passage and said temperature-sensing chamber, for delaying the thermal transfer of a temperature change from the refrigerant in said return passage to said sealed charge within said temperature-sensing chamber, said thermal-transfer-delay means comprising a plug having a transfer path formed therein for the transfer of both temperature and pressure changes to said temperature sensing chamber.

18. Expansion valve as in claim 17, wherein said thermal-transfer-delay means is made from a material with a low thermal conductivity.

19. Expansion valve as in claim 17, wherein said thermal-transfer-delay means is a flow restrictor, preferably made from a material with low thermal conductivity, and being capable of restricting the flow of refrigerant from said return passage towards said temperature-sensing chamber.

20. Expansion valve as in claim 17, wherein said push-rod is made from a material with a low thermal conductivity.

21. Expansion valve as in claim 20, wherein said push-rod is a tube extending at least between the return passage and said temperature-sensing chamber.

22. Expansion valve as in claim 17, wherein said thermal-transfer-delay means is an intermediary plug made of rubber or plastics or a porous material with a low thermal conductivity.

23. Expansion valve as in claim 17, wherein said temperature-sensing chamber is supported by a seat body releasably fixed to one exterior end of said housing close to said return passage, said seat body being fixed in a housing bore intersecting said return passage, said intermediary plug being provided inside said seat body and inside said housing bore.

24. Expansion valve as in claim 23, wherein said intermediary plug is fixed to said seat body or to said housing bore or to said push-rod.

25. Expansion valve as in claim 22, wherein said intermediary plug is designed with a smaller exterior dimension than the inner diameter of said seat body so that said intermediary plug defines at least one restricted flow gap between said seat body and said intermediary plug circumference.

26. Expansion valve as in claim 20, wherein said push rod is made from steel with a minimal cross section of least over its extension between the return passage and said temperature-sensing chamber.

27. An expansion valve for controlling the flow rate of a refrigerant supplied to an evaporator of a refrigerating system, comprising;

an expansion valve housing with a high-pressure supply passage and a low-pressure return passage;

a temperature-sensing chamber located to sense the temperature and pressure of the refrigerant returning from said evaporator, said temperature-sensing chamber containing 1) a sealed charge of at least a saturated vapor gas, and 2) a displaceable diaphragm wall having a surface within said temperature-sensing chamber;

a valve mechanism including a valve in said supply passage, said valve mechanism being actuated by displacement of said diaphragm wall via at least one push-rod to open and to close said supply passage; and thermal-transfer-delay means, separating said temperature-sensing chamber from said return passage and provided between said return passage and said temperature-sensing chamber, for delaying the thermal transfer of a temperature change from the refrigerant in said return passage to said sealed charge within said temperature-sensing chamber, said thermal-transfer-delay means comprising an intermediary plug made of one of rubber, plastics, and a porous material with a low thermal conductivity, said intermediary plug being fixed to one of said seat body and said housing bore and being pierced by at least one small-sized channel or bore extending from the return passage towards the lower side of said diaphragm wall of said temperature-sensing chamber.

28. An expansion valve for controlling the flow rate of a refrigerant supplied to an evaporator of a refrigerating system, comprising;

an expansion valve housing with a high-pressure supply passage and a low-pressure return passage;

a temperature-sensing chamber located to sense the temperature and pressure of the refrigerant returning from said evaporator, said temperature-sensing chamber containing 1) a sealed charge of at least a saturated vapor gas, and 2) a displaceable diaphragm wall having a surface within said temperature-sensing chamber;

a valve mechanism including a valve in said supply passage, said valve mechanism being actuated by displacement of said diaphragm wall via at least one push-rod to open and to close said supply passage; and thermal-transfer-delay means, separating said temperature-sensing chamber from said return passage and provided between said return passage and said temperature-sensing chamber, for delaying the thermal transfer of a temperature change from the refrigerant in said return passage to said sealed charge within said temperature-sensing chamber, said thermal-transfer-delay means comprising an intermediary plug made of one of rubber, plastics, and a porous material with a low thermal conductivity, said intermediary plug being designed with a sliding bore said push-rod extending through said sliding bore towards said lower side of said diaphragm wall, the inner diameter of said sliding bore being slightly larger than the exterior diameter of said push-rod so that a restricted flow channel is defined between the said push-rod and said intermediary plug.

29. An expansion valve for controlling the flow rate of a refrigerant supplied to an evaporator of a refrigerating system, comprising;

an expansion valve housing with a high-pressure supply passage and a low-pressure return passage;

a temperature-sensing chamber which is located on an exterior side of said housing proximate said return passage and which senses the temperature and the pressure of the refrigerant returning from said evaporator, said temperature-sensing chamber containing 1) a sealed charge of at least a saturated vapor gas, and 2) a displaceable diaphragm wall having a surface within said temperature-sensing chamber;

a valve mechanism including a vale in said supply passage, said valve mechanism being actuated by displacement of said diaphragm wall via at least one push-rod to open and to close said supply passage; and thermal-transfer-delay means, separating said temperature-sensing chamber from said return passage and provided between said return passage and said temperature-sensing chamber, for delaying the thermal transfer of a temperature change from the refrigerant in said return passage to said sealed charge within said temperature-sensing chamber, said thermal-transfer-delay means comprising a plug having a transfer path formed therein for the transfer of both temperature and pressure changes to said temperature sensing chamber.

30. An expansion valve for controlling the flow rate of a refrigerant supplied to an evaporator of a refrigerating system, comprising:

an expansion valve housing a with a high-pressure supply passage and a low-pressure return passage;

a temperature-sensing chamber located to sense the temperature and pressure of the refrigerant returning from said evaporator, said temperature-sensing chamber containing a sealed charge of at least a saturated vapor gas and a displaceable diaphragm wall having an inside surface within said temperature-sensing chamber;

a valve mechanism including a valve in said supply passage, said valve mechanism being actuated by displacement of said diaphragm wall via at least one push-rod to open and close said supply passage, and adsorption means, fixed to said inside surface of said diaphragm wall, for adsorbing a liquefied part of said saturated vapor gas which is condensed and liquefied on said surface and for holding said liquefied part on said surface of said diaphragm wall inside said temperature-sensing chamber; and thermal-transfer-delay means, separating said temperature-sensing chamber from said return passage and provided between said return passage and said temperature-sensing chamber, for delaying the thermal transfer of a temperature change from the refrigerant in said return passage to said sealed charge within said temperature-sensing chamber.

* * * * *

UNITED STATES PATENT AND TRADEMARK OFFICE

CERTIFICATE OF CORRECTION

PATENT NO. : 5,303,864

DATED : April 19, 1994

INVENTOR(S) : Hisatoshi Hirota

It is certified that error appears in the above-identified patent and that said Letters Patent is hereby corrected as shown below:

On the title page:

Item (22) Filed: "Dec. 14, 1992" should read -- May 14, 1992 --.

Item (73) Assignee: Add -- T.G.K. Co., Ltd. --.

Signed and Sealed this

Second Day of August, 1994

*Attest:*

*Attesting Officer*

BRUCE LEHMAN

*Commissioner of Patents and Trademarks*